US006918155B2

(12) United States Patent
Yacobi

(10) Patent No.: US 6,918,155 B2
(45) **Date of Patent: *Jul. 19, 2005**

(54) DUAL AGITATOR DRIVE SYSTEM WITH WORM GEAR

(75) Inventor: Michael S. Yacobi, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 374 days.

This patent is subject to a terminal disclaimer.

(21) Appl. No.: 10/251,400

(22) Filed: Sep. 20, 2002

(65) Prior Publication Data

US 2004/0055106 A1 Mar. 25, 2004

(51) Int. Cl.[7] ..... A47L 9/04

(52) U.S. Cl. ..... 15/384; 15/389; 15/41.1; 15/50.3; 15/52.1

(58) Field of Search ..... 15/384, 389, 390, 15/391, 41.1, 52.1, 50.3, 82, 340.4

(56) References Cited

U.S. PATENT DOCUMENTS

| | | | | |
|---|---|---|---|---|
| 1,900,889 A | * | 3/1933 | Becker | 15/384 |
| 2,941,232 A | | 6/1960 | Milbourne | |
| 3,624,861 A | | 12/1971 | Freiheit | |
| 4,357,730 A | | 11/1982 | Lex | |
| 4,419,784 A | | 12/1983 | Lex | |
| 4,426,751 A | | 1/1984 | Nordeen | |
| 4,489,620 A | | 12/1984 | Simm et al. | |
| 4,542,556 A | | 9/1985 | Hepple | |
| 4,624,025 A | | 11/1986 | Kaulig et al. | |
| 4,654,927 A | | 4/1987 | Novinger | |
| 4,733,432 A | | 3/1988 | Novoselsky | |
| 4,845,794 A | | 7/1989 | Korski et al. | |
| 5,018,240 A | | 5/1991 | Holman | |
| 5,056,186 A | | 10/1991 | Jiam-Fa | |
| 5,611,106 A | | 3/1997 | Wulff | |
| 5,784,754 A | * | 7/1998 | Roden et al. | 15/385 |
| 6,030,465 A | | 2/2000 | Marcussen et al. | |
| 6,772,475 B2 | * | 8/2004 | Weber et al. | 15/383 |

* cited by examiner

*Primary Examiner*—Theresa T. Snider
(74) *Attorney, Agent, or Firm*—King & Schickli, PLLC

(57) ABSTRACT

A floor cleaning apparatus such as an upright vacuum cleaner, an extractor or a powerhead for a canister vacuum cleaner includes twin agitators that are operatively connected together by means of a worm gear drive assembly.

24 Claims, 3 Drawing Sheets

20
10
18
22
32
12
16
46
46
35
34
50
14
30
38a
36
38b 38b
38a
34
88
86
95
90
78
80
82
76
74
72
68
84
90
70
14
66
62
64
61
60
35
16

DUAL AGITATOR DRIVE SYSTEM WITH WORM GEAR

TECHNICAL FIELD

The present invention relates generally to the carpet cleaner field, and, more particularly, to an agitator drive system for a floor cleaning apparatus such as for a powerhead, an upright vacuum cleaner or an extractor including twin agitators for brushing dirt and debris from a surface being cleaned.

BACKGROUND OF THE INVENTION

Upright vacuum cleaners in all of their designs and permutations have become increasingly popular over the years. Upright vacuum cleaners generally incorporate a nozzle assembly which rides on wheels over the floor surface to be cleaned. A canister assembly is pivotally mounted to the nozzle assembly. The canister assembly includes an operating handle that is manipulated by the user to move the vacuum cleaner back and forth across the floor. The canister assembly also includes either a bag-like filter or a cyclonic separation chamber and filter combination that traps dirt and debris while substantially clean air is exhausted by a fan that is driven by an onboard electric motor. It is this fan and motor arrangement that generates the drop in air pressure necessary to provide the desired cleaning action. In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

Powerheads generally include a nozzle opening, a rotary agitator in the nozzle opening and a motor for driving the rotary agitator through a drive transmission system. In either an upright vacuum cleaner/extractor nozzle or a powerhead assembly, as the single agitator rotates and engages the surface being cleaned, it has a tendency to pull or push forward or backward depending upon its direction of rotation. At certain times and under certain operating conditions, this imparted motion becomes a hindrance to the user's effective operation and directing of the upright vacuum cleaner/extractor or powerhead and impedes its ease of operation.

In order to address this shortcoming, the present invention relates to any form of floor cleaning apparatus (e.g. a powerhead or upright vacuum cleaner/extractor) incorporating twin agitators that may be made counter-rotating. In this way the net pulling and pushing effect of each agitator is effectively canceled to significantly ease manipulation of the powerhead or vacuum cleaner/extractor by the user. Additionally, the present invention relates to a unique, novel and efficient drive system for the twin agitators.

SUMMARY OF THE INVENTION

In accordance with the purposes of the present invention as described herein, an improved agitator drive system is provided. That agitator drive system includes a housing and a nozzle opening in the housing.

A first rotary agitator and a second rotary agitator are carried on/by the housing. Additionally, a drive motor is carried on/by the housing. A belt and pulley assembly connects the drive motor to the first rotary agitator. A worm gear drive assembly connects the first rotary agitator to the second rotary agitator. In this way a single motor drives both agitators.

Still more specifically describing the invention, the belt and pulley assembly includes a drive shaft, a drive pulley, a first belt connecting said drive shaft and drive pulley and a second belt connecting the drive pulley to the first rotary agitator.

The worm gear drive assembly includes (1) a first worm wheel connected to the first rotary agitator by a first drive shaft, (2) a second worm wheel connected to the second rotary agitator by a second drive shaft, (3) a first worm engaging the first worm wheel, (4) a second worm engaging the second worm wheel and (5) a drive transfer shaft. Both of the worms are connected to the drive transfer shaft.

A series of bearings ensure smooth and efficient operation of the worm gear drive assembly. Specifically, bearings are provided on each end of the first drive shaft, the second drive shaft and the drive transfer shaft.

By mounting the worms on the drive transfer shaft so that the worms run in opposite directions, the agitators are made counter-rotating. By mounting the worms on the drive transfer shaft so that the worms run in the same direction, the agitators are made co-rotating.

In accordance with three further aspects of the present invention, an upright vacuum cleaner, an extractor and a powerhead are provided incorporating the agitator drive system as described.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present invention, an example of which is illustrated in the accompanying drawing.

DETAILED DESCRIPTION OF THE INVENTION

Figure 1:
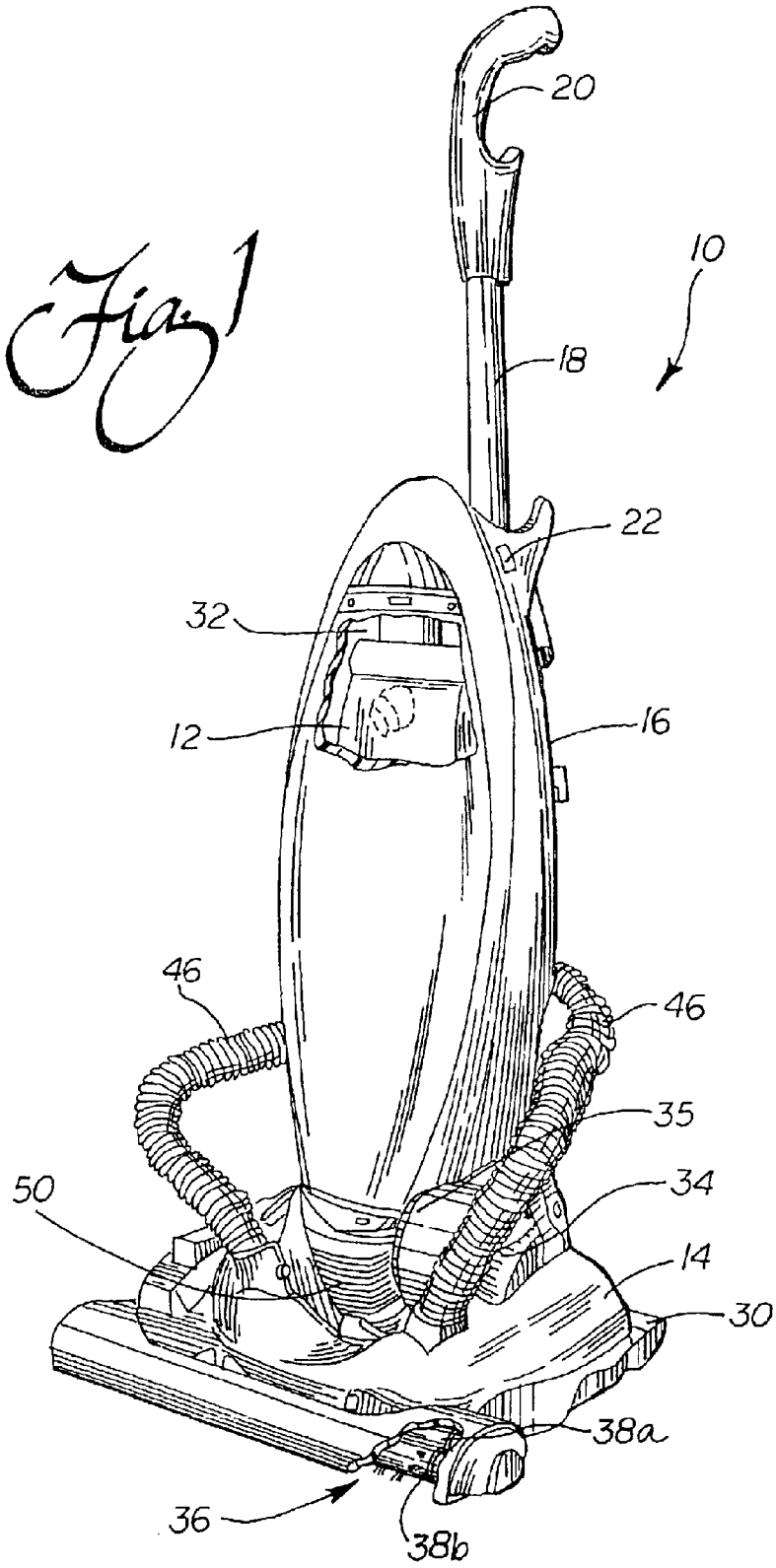
FIG. 1 is a perspective view of an upright vacuum cleaner of the present invention.

Reference is now made to FIG. 1 showing the upright vacuum cleaner 10 of the present invention. The upright vacuum cleaner 10 includes a housing comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through a cord (not shown).

A pair of rear wheels (not shown) are provided at the lower portion of the canister assembly 16 and a pair of front wheels (not shown) are provided on the nozzle assembly 14. Together, these wheels support the vacuum cleaner 10 for movement across the floor. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated to-and-fro to clean the floor.

The canister assembly 16 includes a cavity 32 adapted to receive and hold a dust bag 12. Alternatively, the vacuum cleaner 10 could be equipped with a dust collection cup such as found on cyclonic type models if desired. Additionally, the canister assembly 16 carries a suction generator including a fan 34 and drive motor 35. The suction generator 34, 35 functions to generate a vacuum airstream for drawing dirt and debris from the surface to be cleaned. While the suction generator 34, 35 is illustrated as being carried on the canister assembly 16, it should be appreciated that it could likewise be carried on the nozzle assembly 14 if desired.

The nozzle assembly 14 includes a nozzle and agitator cavity 36 that houses a pair of rotating agitator brushes 38*a* and 38*b*. The agitator brushes 38*a* and 38*b* shown are rotatably driven by the drive motor 35 through a cooperating belt and gear drive system 60 shown in FIGS. 2 and 3 and described in detail below. In the illustrated vacuum cleaner 10, the scrubbing action of the rotary agitator brushes 38*a*, 38*b* and the negative air pressure created by the suction generator 34, 35 cooperate to brush and beat dirt and dust from the nap of the carpet being cleaned and then draw the dirt and dust laden air from the agitator cavity 36 to the dust bag 12. Specifically, the dirt and dust laden air passes serially through hoses 46 and/or an integrally molded conduit in the nozzle assembly 14 and/or canister assembly 16 as is known in the art. Next, it is delivered into the dust bag 12 which serves to trap the suspended dirt, dust and other particles inside while allowing the now clean air to pass freely through to the suction fan 34, pass over the motor 35, through a final filtration cartridge (not shown) and ultimately to the environment through the exhaust port 50.

Figure 2:
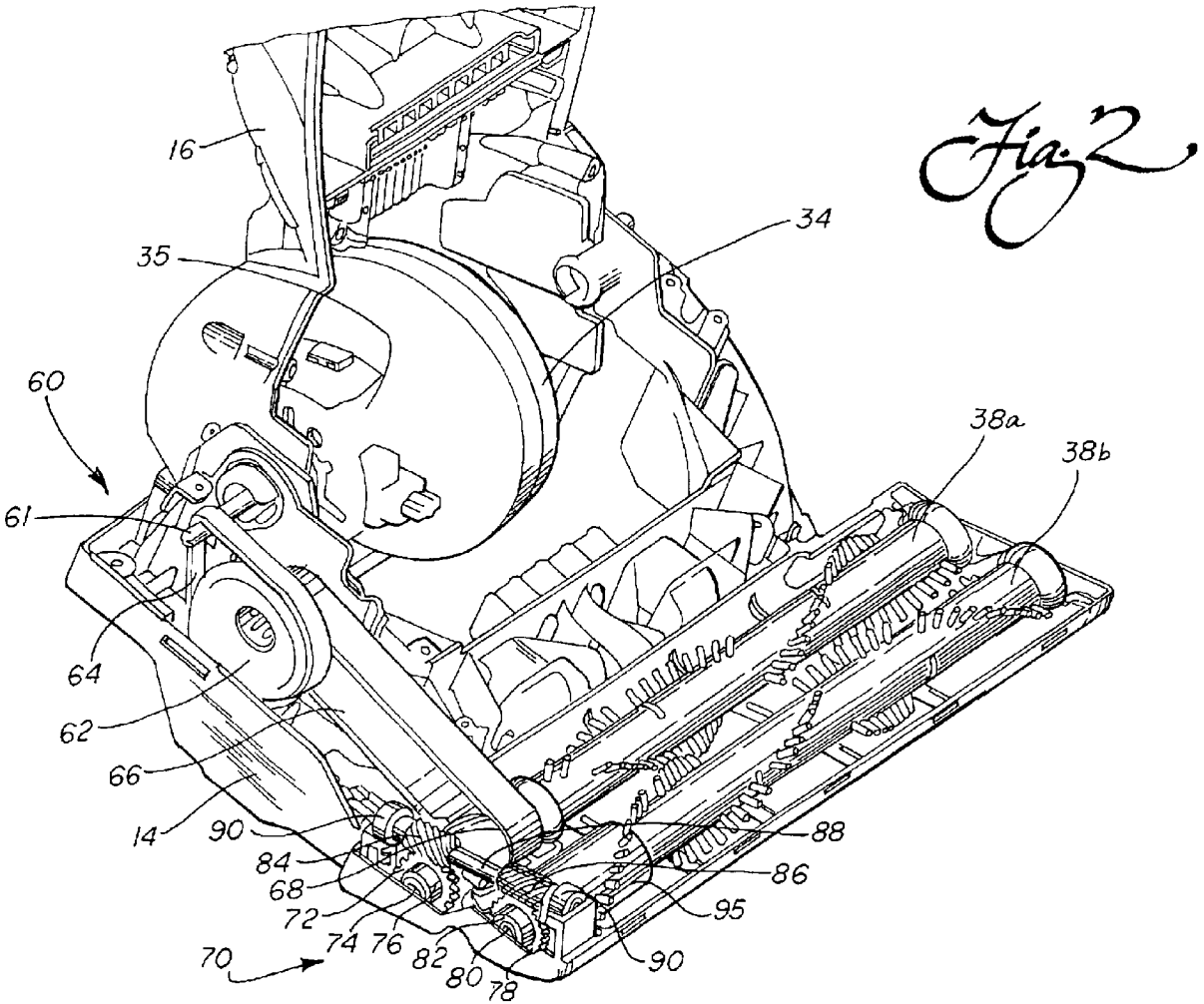
FIG. 2 is an overall detailed perspective view of the agitator drive system of that vacuum cleaner.
Figure 3:
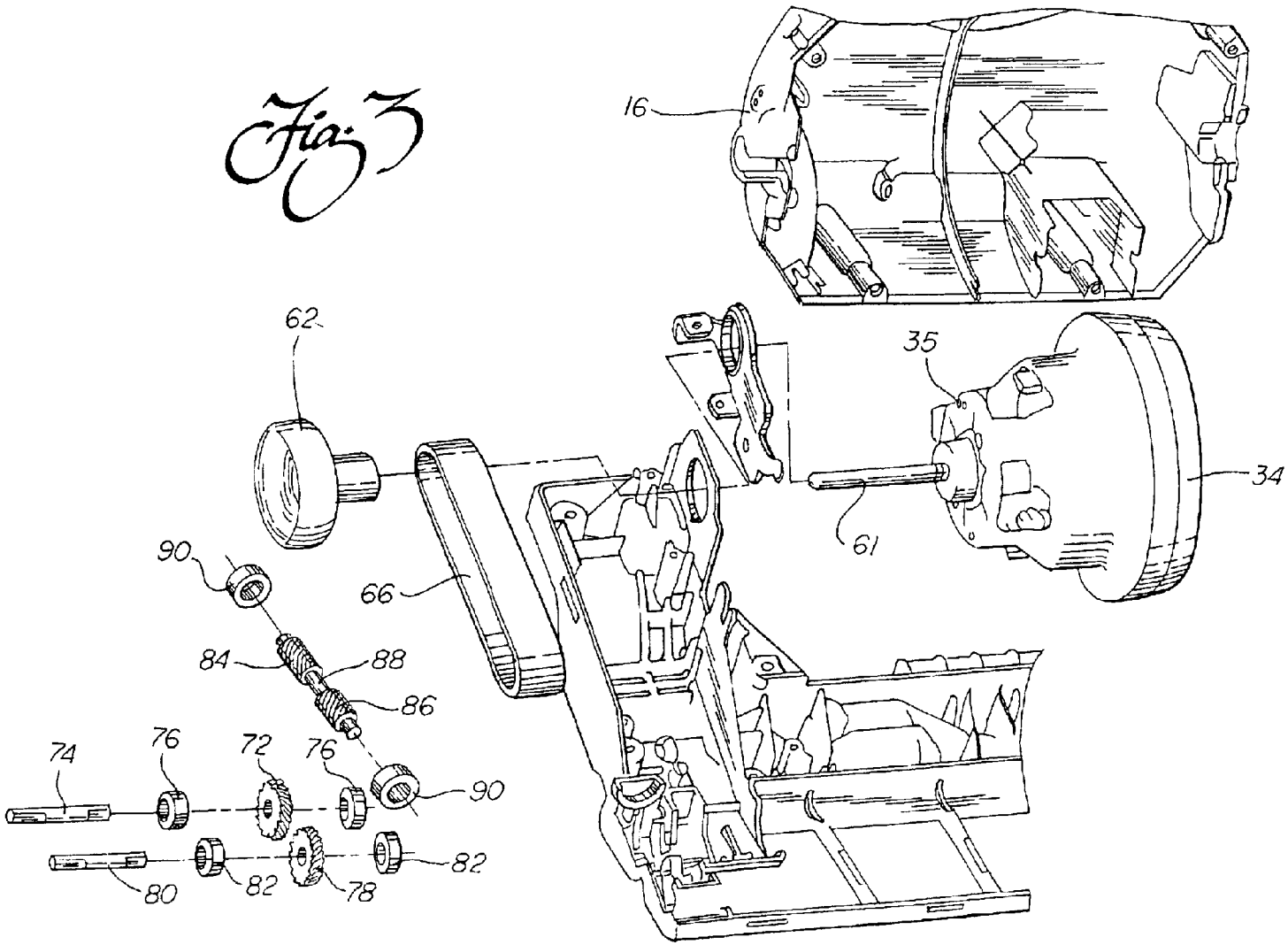
FIG. 3 is an exploded perspective view of the agitator drive system shown in FIG. 2.

The agitator drive system or arrangement 60 shown in FIGS. 2 and 3 includes a motor drive shaft 61 connected to the drive motor 35 that turns the suction fan 34. Drive shaft 61 is connected by a first belt 64 to a dual drive pulley 62 carried for relative rotation on the nozzle assembly 14. A second belt 66 connects the pulley 62 to the agitator pulley 68 carried on the first rotary agitator 38*a*. The dual drive pulley 62 provides a speed reduction so that the rotary agitator 38*a* is driven at optimal speed while the drive motor 35 simultaneously turns the suction fan 34 at the necessary high RPM to generate the desired negative pressure for vacuum cleaning.

As should be appreciated thus far, only the first rotary agitator 38*a* is driven by the second belt 66. The second rotary agitator 38*b* is driven through a worm gear drive assembly generally designated by reference numeral 70. The worm gear drive assembly 70 includes a first worm wheel 72 mounted on a first drive shaft 74 which connects the first worm wheel to the first agitator 38*a*. The first drive shaft 74 is held in bearings 76 on each side of the first worm wheel 72 in order to ensure smooth and efficient rotation of the shaft, wheel and agitator with respect to the body of the nozzle assembly 14.

The worm gear drive assembly 70 also includes a second worm wheel 78 mounted on a second drive shaft 80 which connects the second worm wheel to the second agitator 38*b*. The second drive shaft 80 is held in bearings 82 on each side of the second worm wheel 78 in order to ensure smooth and efficient rotation of the shaft, wheel and agitator with respect to the body of the nozzle assembly 14.

The worm gear drive assembly 70 further includes a first worm 84 that operatively engages the first worm wheel 72 and a second worm 86 that operatively engages the second worm wheel 78. The two worms 84, 86 are keyed or otherwise connected to a common drive transfer shaft 88. The drive transfer shaft 88 is held in two bearings 90 (one provided at each end) to allow for smooth and efficient rotation of the worms 84, 86 and shaft 88 relative to the body of the nozzle assembly 14.

In operation, the motor 35 turns the motor drive shaft 61. The drive shaft 61 turns the dual drive pulley 62 to which it is connected by means of the belt 64. The dual drive pulley 62 provides for speed reduction and turns the first agitator 38*a* through connection of the belt 66. The first agitator 38*a* is keyed to the end of the first drive shaft 74 so that the shaft 74 turns with the agitator 38*a*. The first worm wheel 72 is keyed or otherwise connected to the shaft 74 and, therefore turns with that shaft.

The first worm wheel 72 engages with the first worm 84 and therefore turns that worm and the drive transfer shaft 88 to which worm 84 is connected. Since the second worm 86 is also connected to the drive transfer shaft 88, the second worm is turned. This turning motion is then imparted to the second agitator 38*b* through (1) engagement of the second worm 86 with the second worm wheel 78, (2) keying or otherwise connecting the second worm wheel with the second drive shaft 80 and (3) keying or otherwise connecting the second agitator 38*b* to the shaft 80.

In the illustrated embodiment, the worms 84, 86 and cooperating wheels 72, 78 run in opposite directions. As a consequence, the agitators 38*a*, 38*b* run in opposite directions and are made counter-rotating. This eliminates any tendency of the rotating agitators to push or pull the floor cleaning apparatus across the floor during the cleaning operation. As a result, the floor cleaning apparatus is easier for the operator to manipulate and move where the operator desires.

Of course, the agitators 38*a*, 38*b* may be made co-rotating if desired. This is accomplished by mounting the worms 84, 86 and cooperating wheels 72, 78 so that they run in the same direction, thereby imparting the same direction of rotation to the agitators 38*a*, 38*b*.

By providing a worm gear drive assembly 70 for driving the second rotary agitator 38*b* off of the first rotary agitator 38*a*, belt drive need only be provided to the first rotary agitator. This advantageously eliminates complicated routing of the belt across both agitators. Further, it should be appreciated that more efficient and complete cleaning is possible than with a vacuum cleaner having both agitators driven by a single belt. This is because the pulley area of each agitator in such a design must be devoid of carpet cleaning structures. This leaves an unbrushed or unbeaten gap of carpet as the vacuum cleaner moves.

In contrast, while the first agitator 38*a* includes a belt pulley 68 and, therefore, cannot include any carpet cleaning structures such as beater bars, brushes, wipers or bristles in the pulley area, the second agitator 38*b* includes such cleaning structures across its entire width including, particularly, in the area 95 immediately aligned with and corresponding to the belt pulley of agitator 38*a*. This provides for complete, highly efficient cleaning. There is no pulley area gap in the present invention and as a consequence, there is no unbrushed or unbeaten gap of carpet when the vacuum cleaner is moved to and fro.

In summary, numerous benefits result from employing the concepts of the present invention. A smooth and efficient agitator drive arrangement is provided for a twin agitator equipped vacuum cleaner or extractor. The system provides full cleaning across the entire width of the nozzle assembly. Further, the worm gear drive assembly 70 is arranged in such a manner that by simply selecting one of two possible alternative drive arrangements, the twin rotary agitators 38*a*, 38*b* may be made counter-rotating or co-rotating depending upon the desires of the vacuum cleaner/extractor manufacturer. Inventory and parts control advantages are realized since a single worm gear assembly 70 need be stocked. Only the direction of mounting of the worms 84, 86 and worm wheels 72, 78 need be changed to convert between counter-rotating and co-rotating agitators.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the belt and pulley assembly could comprise a pulley on the motor drive shaft, a pulley on the agitator and a single belt between these two pulleys. Still further, belts may be entirely eliminated by providing a direct gear drive between the motor drive shaft 61 and first agitator 38*a* if desired. For example, the drive transfer shaft could be directly coupled to the armature shaft or it could even be the armature shaft. In addition, the worm wheels 72, 78 could be formed integrally (e.g. by molding or cutting) on the agitators 38*a*, 38*b* thereby eliminating the drive shafts 74, 80. Further, while an upright vacuum cleaner is illustrated, an extractor or even the powerhead of a canister vacuum cleaner could be equipped with the agitator drive system of the present invention.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An agitator drive system, comprising:

a housing;

a first rotary agitator carried on said housing;

a second rotary agitator carried on said housing;

a drive motor carried on said housing;

a belt and pulley assembly directly connecting said drive motor to said first rotary agitator; and a worm gear drive assembly connecting said first rotary agitator to said second rotary agitator.

2. The agitator drive system of claim 1 wherein said belt and pulley assembly includes a drive shaft, a drive pulley, a first belt connecting said drive shaft to said drive pulley and a second belt connecting said drive pulley to said first rotary agitator.

3. The agitator drive system of claim 1, wherein said worm gear drive assembly includes a first worm wheel connected to said first rotary agitator by a first drive shaft, a second worm wheel connected to said second rotary agitator by a second drive shaft, a first worm engaging said first worm wheel, a second worm engaging said second worm wheel and a drive transfer shaft, both said first and second worms being connected to said drive transfer shaft.

4. The agitator drive system of claim 3, further including a first bearing on a first end of said first drive shaft, a second bearing on a second end of said first drive shaft, a third bearing of a first side of said second drive shaft, a fourth bearing on a second end of said second drive shaft, a fifth bearing on a first end of said drive transfer shaft and a sixth bearing on a second end of said drive transfer shaft.

5. The agitator drive system of claim 3, wherein said first and second rotary agitators are co-rotating.

6. The agitator drive system of claim 3, wherein said first and second rotary agitators are counter-rotating.

7. A floor cleaning apparatus, comprising:

a housing;

a nozzle opening in said housing;

a dust collector carried by said housing;

a suction generator carried by said housing, said suction generator drawing air, dirt and debris from a surface to be cleaned through the nozzle opening to said dust collector;

a first rotary agitator carried by said housing;

a second rotary agitator carried by said housing;

a drive motor carried on said housing;

a belt and pulley assembly directly connecting said drive motor to said first rotary agitator; and a worm gear drive assembly connecting said first rotary agitator to said second rotary agitator.

8. The floor cleaning apparatus of claim 7, wherein said drive motor drives said suction generator.

9. The floor cleaning apparatus of claim 7, wherein said belt and pulley assembly includes a drive shaft, a drive pulley, a first belt connecting said drive shaft to said drive pulley and a second belt connecting said drive pulley to said first rotary agitator.

10. The floor cleaning apparatus of claim 7, wherein said worm gear drive assembly includes a first worm wheel connected to said first rotary agitator by a first drive shaft, a second worm wheel connected to said second rotary agitator by a second drive shaft, a first worm engaging said first worm wheel, a second worm engaging said second worm wheel and a drive transfer shaft, both said first and second worms being connected to said drive transfer shaft.

11. The floor cleaning apparatus of claim 10, further including a first bearing on a first end of said first drive shaft, a second bearing on a second end of said first drive shaft, a third bearing of a first side of said second drive shaft, a fourth bearing on a second end of said second drive shaft, a fifth bearing on a first end of said drive transfer shaft and a sixth bearing on a second end of said drive transfer shaft.

12. The floor cleaning apparatus of claim 10, wherein said first and second rotary agitators are co-rotating.

13. The floor cleaning apparatus of claim 10, wherein said first and second rotary agitators are counter-rotating.

14. A powerhead, comprising:

a housing;

a nozzle opening in said housing;

a first rotary agitator carried on said housing;

a second rotary agitator carried on said housing;

a drive motor carried on said housing;

a belt and pulley assembly directly connecting said drive motor to said first rotary agitator; and a worm gear drive assembly connecting said first rotary agitator to said second rotary agitator.

15. The powerhead of claim 14 wherein said belt and pulley assembly includes a drive shaft, a drive pulley, a first belt connecting said drive shaft to said drive pulley and a second belt connecting said drive pulley to said first rotary agitator.

16. The powerhead of claim 14, wherein said worm gear drive assembly includes a first worm wheel connected to said first rotary agitator by a first drive shaft, a second worm wheel connected to said second rotary agitator by a second drive shaft, a first worm engaging said first worm wheel, a second worm engaging said second worm wheel and a drive transfer shaft, both said first and second worms being connected to said drive transfer shaft.

17. The powerhead of claim 16, further including a first bearing on a first end of said first drive shaft, a second bearing on a second end of said first drive shaft, a third bearing of a first side of said second drive shaft, a fourth bearing on a second end of said second drive shaft, a fifth bearing on a first end of said drive transfer shaft and a sixth bearing on a second end of said drive transfer shaft.

18. The powerhead of claim 16, wherein said first and second rotary agitators are co-rotating.

19. The powerhead of claim 16, wherein said first and second rotary agitators are counter-rotating.

20. A method of driving twin agitators of a floor cleaning apparatus, comprising:

directly connecting a drive motor to a first agitator of said twin agitators by means of a belt and pulley assembly; and operatively connecting a second agitator of said twin agitators to said first agitator by a worm gear drive.

21. A floor cleaning apparatus, comprising:

a housing;

a nozzle opening in said housing;

a dust collector carried by said housing;

a suction generator carried by said housing, said suction generator drawing dirt and debris from a surface to be cleaned through the nozzle opening to said dust collector;

a first rotary agitator carried by said housing;

a second rotary agitator carried by said housing;

a belt and pulley assembly directly connecting said first rotary agitator to a drive motor; and a worm gear drive assembly connecting said first and second rotary agitators wherein said first and second rotary agitators are co-rotating.

22. The floor cleaning apparatus of claim 21, wherein said worm gear drive assembly includes a first worm wheel on/connected to said first rotary agitator, a second worm wheel on/connected to said second rotary agitator, a first worm engaging said first worm wheel, a second worm engaging said second worm wheel and a drive transfer shaft, both said first and second worms being connected to said drive transfer shaft.

23. The floor cleaning apparatus of claim 21, wherein said first and second rotary agitators are counter-rotating.

24. The floor cleaning apparatus of claim 21, wherein said first and second rotary agitators are both rotated about horizontal axes.

* * * * *